US006202335B1

(12) United States Patent
Shelton et al.

(10) Patent No.: US 6,202,335 B1
(45) Date of Patent: Mar. 20, 2001

(54) PLASTIC LOCKET FOR A HANG TAG

(76) Inventors: Paul Shelton; Susan Shelton, both of 126 N. Vine St., Hinsdale, IL (US) 60521

( * ) Notice: Subject to any disclaimer, the term of this patent is extended or adjusted under 35 U.S.C. 154(b) by 0 days.

(21) Appl. No.: 09/089,995

(22) Filed: Jun. 3, 1998

(51) Int. Cl.[7] ..... G09F 3/18

(52) U.S. Cl. ..... 40/661.06; 40/661; 206/449

(58) Field of Search ..... 40/1.6, 634, 636, 40/661, 661.05, 661.06, 661.07, 668, 705, 706, 781; 206/0.8, 0.82, 232, 449, 450; 150/147; 70/456 R, 460; 292/307 A, 307 B; 43/25.2; 63/19

(56) References Cited

U.S. PATENT DOCUMENTS

| | | | | |
|---|---|---|---|---|
| 857,140 | | 6/1907 | Woods . | |
| 1,095,829 | | 5/1914 | Dunlap . | |
| 1,100,022 | | 6/1914 | Lawrence . | |
| 1,122,941 | | 12/1914 | Kameras et al. . | |
| 1,255,870 | * | 2/1918 | Foster | 63/19 |
| 1,266,256 | * | 5/1918 | Hathaway | 63/19 |
| 1,718,236 | | 6/1929 | James . | |
| 2,385,778 | | 10/1945 | Evalt . | |
| 2,767,502 | * | 10/1956 | Reynolds | 43/25.2 |
| 3,111,152 | | 11/1963 | Goessling . | |
| 3,141,258 | * | 7/1964 | Mayer | 43/25.2 |
| 3,407,523 | | 10/1968 | Winston . | |
| 3,618,338 | | 11/1971 | Sauer . | |
| 4,015,361 | * | 4/1977 | O'Reilly et al. | 43/25.2 |
| 4,215,497 | | 8/1980 | Levy . | |
| 4,452,003 | * | 6/1984 | Deutsch et al. | 43/25.2 |
| 4,524,867 | | 6/1985 | Klein et al. . | |
| 4,787,168 | * | 11/1988 | Benit et al. | 43/25.2 |
| 4,829,691 | | 5/1989 | Manjos et al. . | |
| 5,033,141 | | 7/1991 | Kang . | |
| 5,123,199 | * | 6/1992 | Lysohir et al. | 43/25.2 X |
| 5,414,948 | | 5/1995 | Kudo . | |
| 5,475,942 | * | 12/1995 | Tatum | 43/25.2 |
| 5,507,492 | | 4/1996 | Adell . | |
| 5,845,424 | * | 12/1998 | Mitchell | 40/661 X |

OTHER PUBLICATIONS

Mary Beth's Beanie Baby World Magazine, vol. 1 No. 2, Dec. 1997.

Computer–generated drawings produced in the lawsuit, Clipp Designs, Inc. v. David J. Whelan, Individually and d/b/a Tagbags, and any other Unknown Owners d/b/a Tagbags (97–C–7678–Northern District of Illinois), depicting the front case view, lower case view and assembled view of a tag protector allegedly created by David J. Whelan. Applicant has reason to believe that the date stamp on the drawings have been falsified and that the dates reflected thereon are inaccurate.

* cited by examiner

*Primary Examiner*—Brian K. Green
(74) *Attorney, Agent, or Firm*—Wallenstein & Wagner, Ltd.

(57) ABSTRACT

A locket for a hang tag is disclosed. The locket includes a first plastic face having a first peripheral edge and a second plastic face having a second peripheral edge. The locket has a through-hole of sufficient size to permit extension of a lanyard therethrough while preventing retraction of a hang tag enclosed therein when the locket is in the closed position. The second face is connectable to the first face.

13 Claims, 1 Drawing Sheet

PLASTIC LOCKET FOR A HANG TAG

TECHNICAL FIELD

The present invention relates to hang tags used in inventorying and merchandising. In particular, the present invention relates to methods and apparatus used to prevent damage to the tags once attached to an article of manufacture by such as a plastic lanyard.

BACKGROUND OF THE INVENTION

Certain labels are applied to goods to provide pre-sale information to consumers, but are designed to be removable. With certain goods, it is either undesirable or impractical to apply such a label directly to the goods. For example, on textiles, a tag is often substituted for conventional adhesive labels to prevent residual adhesive from damaging or soiling the textile. These tags are attached to the textile by a lanyard (usually plastic or braided fibre such as a string) which is extended through the textile fibers or another unintrusive portion of the textile such as a button hole.

There has been an increased desire to protect the hang tags which accompany many collectibles, in particular those on plush animal toys. Because the value of some collectibles can decrease if there is damage to the accompanying tag or lanyard, it is of utmost importance to prevent damage to either the lanyard or the tag.

Plastic sheeting or coating is at times used to cover and protect certain hang tags. Such sheeting and coating are usually only expected to prevent soiling of the tag. However, such sheeting or coating is too flexible to prevent bending of the hang tag caused by ordinary handling and storage. At the same time, conventional rigid casement structures meant to secure and protect photos, keepsakes, badges and the like, would not be adequate to protect hang tags, especially hang tags on collectibles. Conventional casements generally require that either a portion of the tag protrude through the casement to accommodate connection of a lanyard thereto, or a separate member be mounted to or formed onto the exterior of the casement.

For example, U.S. Pat. No. 4,215,497 to Levy proposes that identification indicia on an identification member be sandwiched between two plastic pieces. The design, however, leaves a portion of the identification member exposed and it utilizes that portion for connection to the lanyard.

Similarly, U.S. Pat. No. 5,414,958 to Kudo proposes a casement-type device, configurable as either a badge or a pendant for holding a paper or plastic disc bearing indicia. The device has a loop member mounted to the top of the casement. The loop member is used for securing the casement to a chain, thereby defining a pendant. This construction is deficient as a hang tag protector. Such a construction would require attaching a lanyard to the casement directly rather than direct attachment to the tag. This would eliminate the cost, choice, and assembly advantages presently provided by hang tag technology. More importantly, where the manufacturer does not supply a protector for a hang tag, a protector would necessarily have to be applied by a consumer after the hang tag was already attached to a collectible item. With the Kudo device, either the original lanyard would have to be detached from the tag then reattached to the loop member, or an additional lanyard would have to be attached at one end to the collectible item with the other end being secured on the loop. Either re-attachment of the OEM lanyard to the loop or piercing the plush with another lanyard, would alter the product in a way which may lessen its value as a collectible.

Also, neither U.S. Pat. No. 4,215,497 nor U.S. Pat. No. 5,414,958 disclose a protective casement where indicia would be visible from more than one side. It would be desirable if a casement-type protector could display the hang tag from two sides, as OEM tags frequently provide information on both sides of the tag. It would also be advantageous to provide a casement-type protector which could be manufactured as a single unit with the ability to open and close the device around a swing tag.

The present invention is provided to solve these and other problems and to provide other advantages. A preferred embodiment will be disclosed and the novel aspects of the present invention will be particularly identified and discussed herein.

SUMMARY OF THE INVENTION

The present invention provides a locket having a first face with a peripheral edge, and a second face with a peripheral edge. The two faces are closed around a hang tag. The locket, in a closed position, further includes a through-hole of sufficient size to permit a lanyard connected to a hang tag to pass through the through-hole, but also to prevent the retraction of the hang tag therethrough. This configuration provides a protective locket for a hang tag, such as a hang tag for a collectible plush toy. Preferably, the locket is made of transparent plastic.

Other advantages and aspects of the present invention will become apparent upon reading the following description of the drawings and detailed description of the invention.

BRIEF DESCRIPTION OF THE DRAWING

In order that the present invention may be more fully understood, it will now be described by way of an exemplary embodiment, with reference to the accompanying drawings in which.

DETAILED DESCRIPTION

Figure 1:
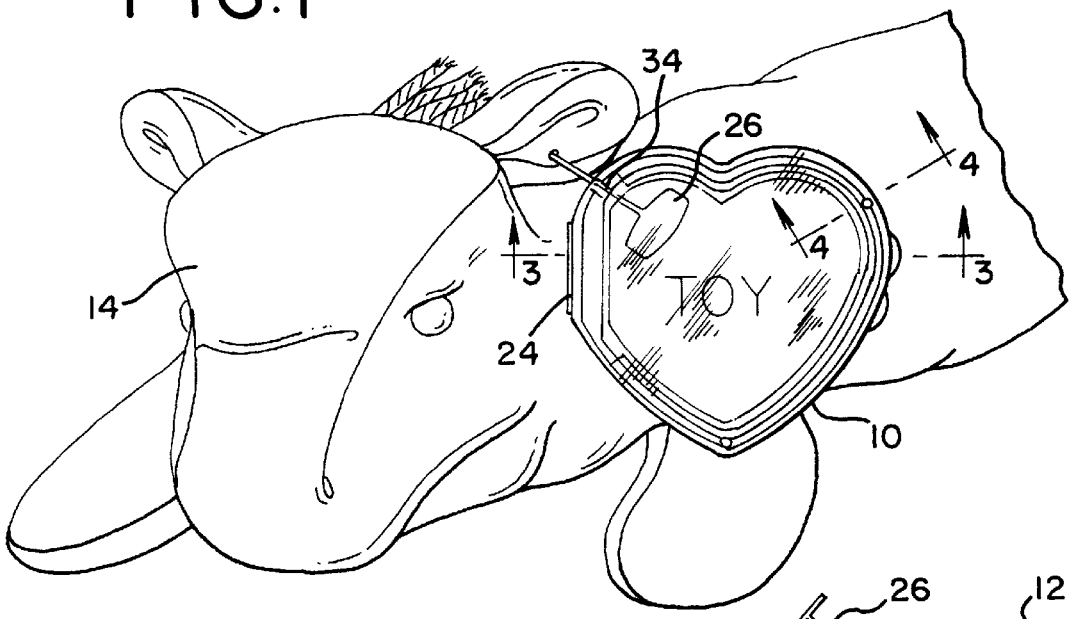
FIG. 1 is a front view of the plastic locket in use, on a hang tag attached to a stuffed animal toy by a lanyard and inserted between the faces of the plastic locket, according to the present invention.

While this invention is susceptible to an embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiments illustrated.

FIGS. 1–4 disclose a locket 10 for a hang tag 12 constructed in accordance with the principles of the present invention. Specifically, the locket 10 provides a protective casement for the hang tag 12 attached to a stuffed animal toy 14.

Figure 2:
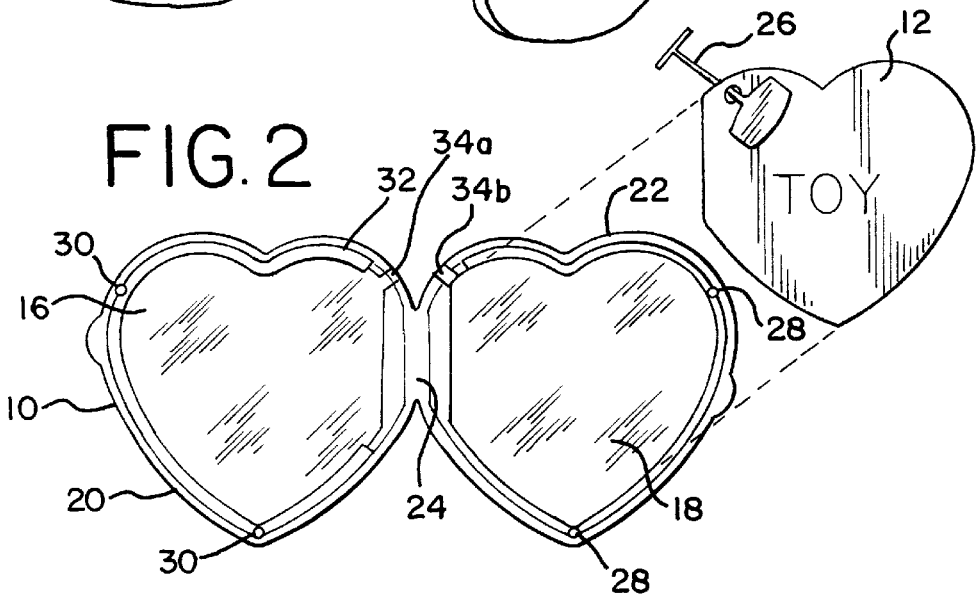
FIG. 2 is a front view of the plastic locket of FIG. 1, illustrating the plastic locket in an open position according to the present invention.

FIG. 2, shows the locket 10 in an open position and discloses that it includes a first transparent plastic face 16, a second transparent plastic face 18. The first face 16 has a first peripheral edge 20 and the second face 18 has a second peripheral edge 22. The second face 18 is connected to the first face 16 by a living hinge 24. Recessed portions 34*a* and 34*b* in the peripheral edges 20,22 form a through-hole 34. The through-hole 34 is sized to permit entry of the lanyard 26 into the locket while at the same time preventing entry or retraction of the hang tag 12 through the through-hole 34 after the hang tag 12 has been confined between the faces 16, 18 of the locket 10.

The open position allows for a consumer to place a hang tag 12 between the first and second faces 16, 18 of the locket 10. In the closed position (FIGS. 1 and 3), the faces 16, 18 of the locket 10 are closed around the hang tag 12. Additionally, the faces 16, 18 of the locket 10 form a compartment 15 in which the hang tag 12 is completely confined. When the locket 10 is in the closed position, a lanyard 26 which secures the hang tag 12 to the stuffed animal toy 14, protrudes through the through-hole 34, thereby, preventing bending and soiling damage to the tag 12. Furthermore, when the locket 10 is in the closed position, the hang tag 12 can not be retracted from the compartment 15 unless the locket 10 is re-opened.

Figure 3:
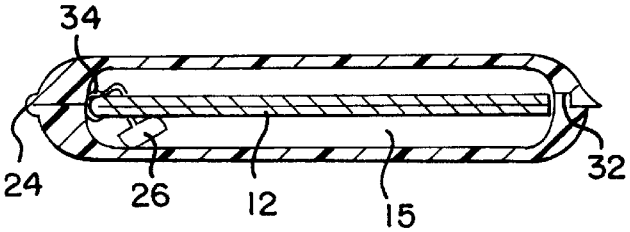
FIG. 3 is a cross-sectional view of the plastic locket of FIG. 1, taken along lines 3—3 of FIG. 1; and, FIG. 4 is a partial cross-sectional view of the plastic locket of FIG. 1, taken along lines 4—4 of FIG. 1.
Figure 4:
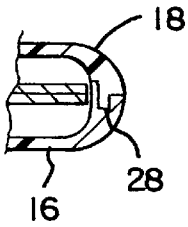

As shown in FIGS. 3 and 4, the preferred embodiment of the locket also includes a plurality of tab-like projections 28 extending outwardly from various predetermined positions on the first peripheral edge 20. The peripheral edge on the second face 18, on the other hand, includes a plurality of apertures 30 aligned with the tab-like projections 28. The apertures 30 frictionally engage the tab-like projections 28 to secure the locket 10 in a closed position. The preferred embodiment further includes a plurality of protruding ridge members 32 disposed on the first peripheral edge 20. The protruding ridge members 32 generally conform to the shape of the second peripheral edge 22, and allow frictional engagement therewith. The protruding ridge members 32 assist in aligning the first face 16 with the second face 18, and assist in maintaining the integrity of the locket 10 when the locket 10 is in the closed position.

The faces 16, 18 of the locket 10 are generally heart-shaped. However, it is contemplated that the faces according to the invention may be any geometric shape whether or not conforming to the shape of a particular hang tag to be confined within the locket.

Also, in the preferred embodiment, the locket 10 is a one piece construction. The first and second faces 16, 18 are hingeably connected by a living or molecular hinge 24 and both the first and second faces 16, 18 are preferably transparent. To achieve transparency in the faces 16, 18 while having a flexible living hinge, polymers of the nature of the one marketed by Philips 66 under the designation K-Resin are suitable. However, it is also contemplated that either or both of the faces 16, 18 of the locket be non-transparent.

While the specific embodiments have been illustrated and described, numerous modifications come to mind without significantly departing from the spirit of the invention and the scope of protection is only limited by the scope of the accompanying Claims.

For example, it is contemplated that the through-hole 34 may be a single aperture, that is formed by only one recess or any opening in the first or the second face 18, or a combination of recesses in both the first and the second face 18, so long as such structures permit entry of the lanyard 26 into the locket 10, but prevent retraction of the hang tag 12 through the through-hole 34 after the hang tag 12 is confined between the faces of the locket 10.

We claim:

1. A method of protecting a hang tag for a toy, the hang tag being attached to a lanyard and bearing indicia relevant to the toy to which the hang tag and lanyard will be attached, the method comprising the steps of:

providing a toy;

providing a lanyard having first and second opposed ends, wherein the first end of the lanyard is attached into the toy;

providing a hang tag for the toy, the hang tag being attached to the second end of the lanyard and the hang tag bearing indicia relevant to the toy;

providing a locket comprising:

a first face having a first peripheral edge;

a second face having a second peripheral edge, the second face being connectable to the first face to form a compartment to confine the hang tag; and, a through-hole leading from the compartment to an exterior of at least one of either the first or second face, wherein the through hole is of sufficient size to permit entry of the lanyard therethrough but to prevent entry or retraction of the hang tag therethrough when the hang tag is confined in the compartment; and, placing the hang tag between the first and second faces; and, closing the first and second faces of the locket around the hang tag such that the hang tag is confined within the compartment of the locket and the lanyard extends through the through-hole.

2. The method of claim 1 wherein the first face of the locket includes a recess at the first peripheral edge, the recess defining the through-hole when the locket is in a closed position.

3. The method of claim 1 wherein the second face of the locket is joined to the first face by a living hinge.

4. The method of claim 1 wherein the first face and the second face are plastic.

5. The method of claim 4 wherein the first face and the second face are substantially transparent.

6. The method of claim 1 wherein the first face includes a first recess at the first peripheral edge and the second face includes a second recess at the second peripheral edge, the first recess being in positional alignment with the second recess such that when the locket is in the closed position the first recess and the second recess define the through-hole.

7. The method of claim 1 further including a plurality of protruding ridge members disposed on the first peripheral edge of the first face, the ridge members conforming to the geometric shape of the second peripheral edge of the second face to frictionally engage the second face.

8. The method of claim 1 wherein the hang tag has a perimeter defined by a predetermined first geometric shape and the compartment defines a predetermined geometric shape which substantially corresponds to the geometric shape of the perimeter of the hang tag.

9. The method of claim 8 wherein the perimeter of the hang tag is heart-shaped and the compartment is heart-shaped.

10. The method of claim 8 wherein the perimeter of the hang tag is heart-shaped and the compartment is circular.

11. A toy in combination with a toy accessory comprising:

a toy;

a hang tag having a perimeter defined by a predetermined geometric shape;

a lanyard having a first and second opposed ends, wherein the first end is attached into the toy, and the second end is attached to the hang tag; and, a locket having a first face having a first peripheral edge and a second face having a second peripheral edge, the second face being connectable to the first face to form a compartment to confine the hang tag, the compartment defining a predetermined geometric shape which substantially corresponds to the geometric shape of the perimeter of the hang tag, the locket further having a through-hole leading from the compartment to an exterior of at least one of either the first or second face, wherein the through hole is of sufficient size to permit entry of the lanyard therethrough but to prevent entry or retraction of the hang tag therethrough when the hang tag is confined in the compartment.

12. The toy accessory of claim 11 wherein the perimeter of the hang tag is heart-shaped and the compartment is generally heart-shaped.

13. The toy accessory of claim 11 wherein the perimeter of the hang tag is heart-shaped and the compartment is generally circular.

* * * * *